US006200670B1

(12) United States Patent
Hosoi et al.

(10) Patent No.: US 6,200,670 B1
(45) Date of Patent: Mar. 13, 2001

(54) RECORDING MEDIUM AND RECORDING METHOD FOR USING THE SAME

(75) Inventors: Nobuyuki Hosoi, Kazo; Akemi Ishizaki, Yokohama; Ako Omata, Kawasaki; Katsutoshi Misuda, Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/022,447

(22) Filed: Feb. 12, 1998

(30) Foreign Application Priority Data

| | | |
|---|---|---|
| Feb. 18, 1997 | (JP) | 9-033815 |
| Feb. 19, 1997 | (JP) | 9-049580 |
| Apr. 10, 1997 | (JP) | 9-106869 |
| Apr. 18, 1997 | (JP) | 9-101760 |

(51) Int. Cl.[7] ..... B41M 5/00

(52) U.S. Cl. ..... 428/212; 428/195; 428/304.4; 347/105

(58) Field of Search ..... 428/195, 328, 428/329, 41.8, 212, 304.4; 347/105

(56) References Cited

U.S. PATENT DOCUMENTS

| | | | |
|---|---|---|---|
| 4,202,870 | 5/1980 | Weber et al. | 423/630 |
| 4,242,271 | 12/1980 | Weber et al. | 260/448 AD |
| 4,879,166 | 11/1989 | Misuda et al. | 428/212 |
| 5,104,730 | 4/1992 | Misuda et al. | 428/304.4 |

FOREIGN PATENT DOCUMENTS

| | | |
|---|---|---|
| 622244A1 | 11/1994 | (EP) . |
| 701904A1 | 3/1996 | (EP) . |
| 742108A1 | 11/1996 | (EP) . |
| 749845A2 | 12/1996 | (EP) . |
| 52-53012 | 4/1977 | (JP) . |
| 55-49113 | 5/1978 | (JP) . |
| 55-5830 | 1/1980 | (JP) . |
| 53-51583 | 4/1980 | (JP) . |
| 55-146786 | 11/1980 | (JP) . |
| 2-276670 | 11/1990 | (JP) . |
| 3-281384 | 12/1991 | (JP) . |
| 4-37576 | 2/1992 | (JP) . |
| 5-32037 | 2/1993 | (JP) . |
| 7-232475 | 9/1995 | (JP) . |

OTHER PUBLICATIONS

J. Roček, et al., "Porous Structure of Aluminum Hydroxide and its Content of Pseudoboehmite", Applied Catalysis, vol. 74, (1991) pp. 29–36.

J. Roček, et al., "Effect of Precipitation and Aging on Porous Structure of Aluminum Hydroxide. I. Statistical Treatment of Experimental Data", Collect. Czech. Chem. Commun., vol. 56, (1991) pp. 1253–1262.

*Primary Examiner*—Pamela R. Schwartz
(74) *Attorney, Agent, or Firm*—Fitzpatrick, Cella, Harper & Scinto

(57) ABSTRACT

There is provided a recording medium comprising a substrate and an ink-receiving layer containing alumina hydrate formed thereon, wherein the alumina hydrate is present unoriented in the ink-receiving layer and a diffraction intensity fluctuation δ in a diffraction pattern is not more than 5%, when irradiating an electron beam to a cross section of the ink-receiving layer.

5 Claims, 6 Drawing Sheets

0.1 μm

×200000

0.1 μm

×200000

RECORDING MEDIUM AND RECORDING METHOD FOR USING THE SAME

BACKGROUND OF THE INVENTION

1. Field of the Invention

This invention relates to a recording medium to be suitably used for ink-jet recording. It also relates to an ink-jet recording method using such a recording medium.

2. Related Background Art

Known ink-jet recording systems normally comprise one or more nozzles for ejecting ink droplets onto a recording medium in order to produce and record pictures and/or characters on the medium. These systems are highly versatile in terms of colors and patterns to be used for recording and adapted to high speed recording without giving off particularly annoying noise and, unlike photography, requiring development and fixing steps. Therefore, they are finding increasingly diverse applications particularly in the field of information-related devices including printers, copying machines, word processors, facsimile machines and plotters. Additionally, in view of the recent development of marketing low cost digital cameras, digital video recorders and scanners and the widespread popularity of personal computers, ink-jet recording systems are expected to be popularly used as output devices for producing images stored in them. In fact, efforts have been made for the ink-jet recording system to meet the requirements of higher recording speed and enhanced high definition and full color recording capability in order to make it competitive with silver halide type color photography and multi color printing of a plate system. In the course of the recent technological development, however, it has been recognized that the recording medium is an important subject matter on which more stress has to be put.

A number of different recording media have been proposed for ink-jet recording. For example, Japanese Patent Application Laid-Open No. 52-53012 discloses a type of ink-jet recording paper prepared by applying a coating paint on low-sized paper. Japanese Patent Application Laid-Open No. 53-49113 discloses another type of ink-jet recording paper prepared by impregnating paper incorporated with a powdery urea-formalin resin therein with a water-soluble polymeric substance. Japanese Patent Application Laid-Open No. 55-5830 discloses still another type of ink-jet recording paper prepared by forming an ink-absorbing coating layer on a surface of substrate. Japanese Patent Application Laid-Open No. 55-51583 describes the use of non-crystalline silica as pigment contained in the coating layer of ink-jet recording paper. Japanese Patent Application Laid-Open No. 55-146786 describes the use of a coating layer of a water-soluble polymeric substance.

Recently, the use of alumina hydrate has been attracting attention for recording media, because it has advantages as compared with conventional recording media. Namely, alumina hydrate shows a remarkable fixing capability for a dye in an ink and an enhanced coloring potential due to its positive electric charge so that it can produce highly glossy images. Japanese Patent Application Laid-Open No. 7-232475 discloses a recording medium in which an alumina hydrate is used for enhancing ink-absorbency and for preventing bleeding. Also, U.S. Pat. Nos. 4,879,166 and 5,104,730 and Japanese Patent Application Laid-Open Nos. 2-276670, 4-37576 and 5-32037 respectively describe recording media comprising an alumina hydrate layer with a pseudo-boehmite structure.

However, for a recording medium containing alumina hydrate to fully compete with silver halide type photography and multi color printing of a plate system in quickly producing a finely defined image, there are a lot of problems including the following that have to be solved.

(1) In case of printing a finely defined color image in a short period of time, since a large volume of ink has to be applied to the surface of the recording medium, the applied ink cannot be fully taken up into the pores of the medium and can bleed and flow over the ink-receiving surface to degrade the image on the medium.

(2) The recording medium is required to absorb ink rapidly for high speed printing, but beading may occur when the applied ink is not absorbed at a sufficiently high rate. The term "beading" as used herein refers to a phenomenon where some or all of the ink dots placed on the recording medium are mingled with adjacent ones to blur the image formed on the medium before the ink is sufficiently absorbed by the medium.

(3) Japanese Patent Application Laid-Open No. 3-281384 describes an alumina hydrate, which is in columnar form and forms an aggrgation oriented in a certain direction, and a method for forming an ink-receiving layer using such alumina hydrate. Japanese Patent Application Laid-Open No. 2-276670 describes a bundle of filaments of alumina sol. However, filament- or column-shaped particles of alumina hydrate can easily and densely agglomerate, presumably because they show a concentrated electric charge along the edges of the particles and hence it is difficult for them to permit an ink to infiltrate into the ink-receiving layer. As a result, such alumina hydrate is not adapted for ink to be used for producing high definition color images in a short period of time as beading can easily occur.

SUMMARY OF THE INVENTION

In view of the above identified problems, therefore, the first object of the present invention is to provide a recording medium for recording fine images that can be used with inks having different compositions and can absorb ink without producing bleeding and beading of ink. The second object of the invention is to provide an ink-jet recording method using such a recording medium.

According to the present invention, there is provided a recording medium comprising a substrate and an ink-receiving layer containing alumina hydrate formed thereon, wherein the alumina hydrate is present unoriented in the ink-receiving layer and a diffraction intensity fluctuation $\delta$ in a diffraction pattern is not more than 5%, when irradiating an electron beam to a cross section of the ink-receiving layer.

According to the present invention there is also provided an ink-jet recording method by ejecting and applying ink droplets onto a recording medium mentioned above.

DETAILED DESCRIPTION OF THE INVENTION

Figure 1:
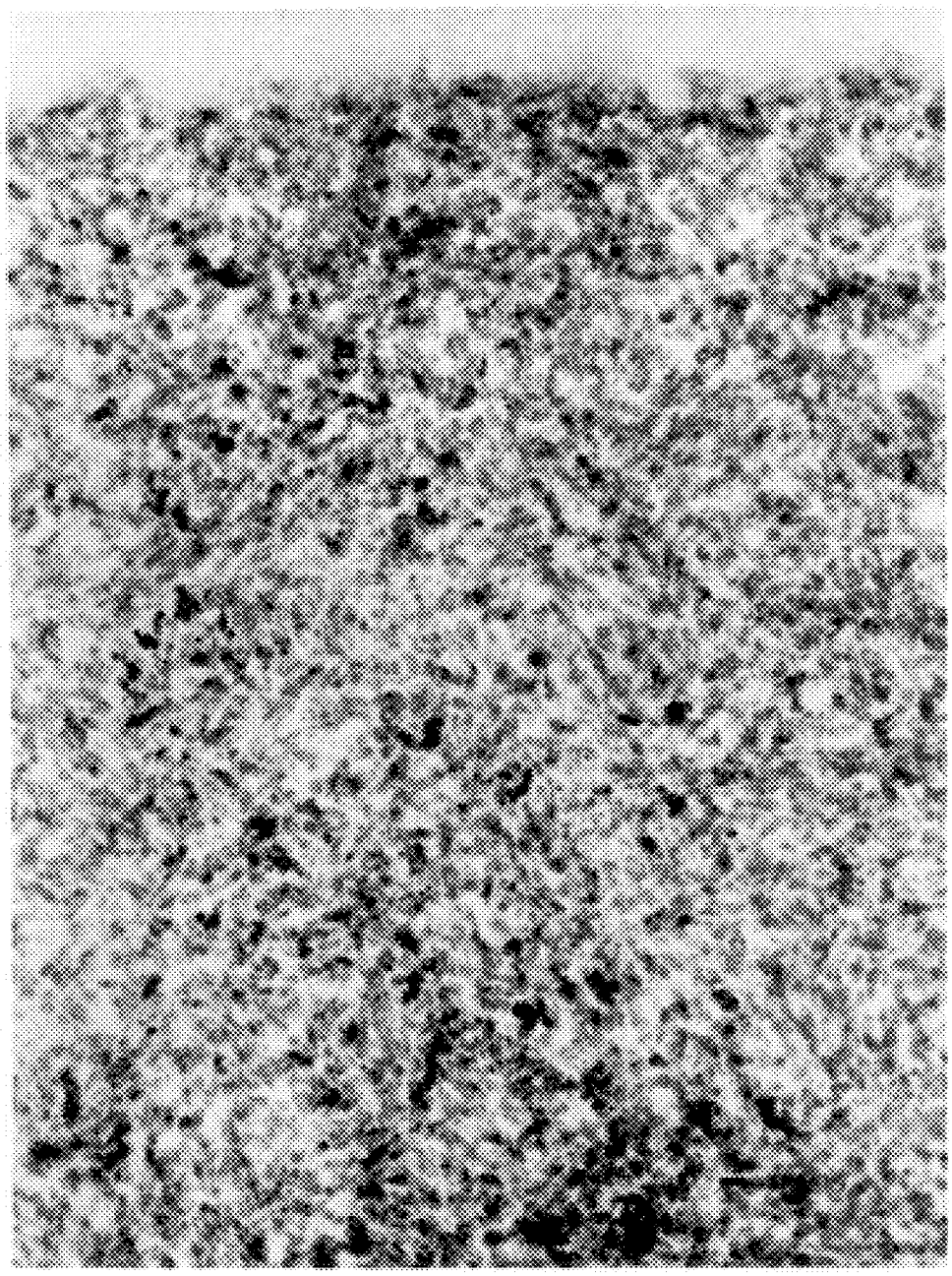
FIG. 1 is a photograph of the ink-receiving layer containing unoriented alumina hydrate of a recording medium according to the present invention that was taken through a transmission electron microscope to show how unoriented alumina hydrate appears in the ink-receiving layer.
Figure 3:
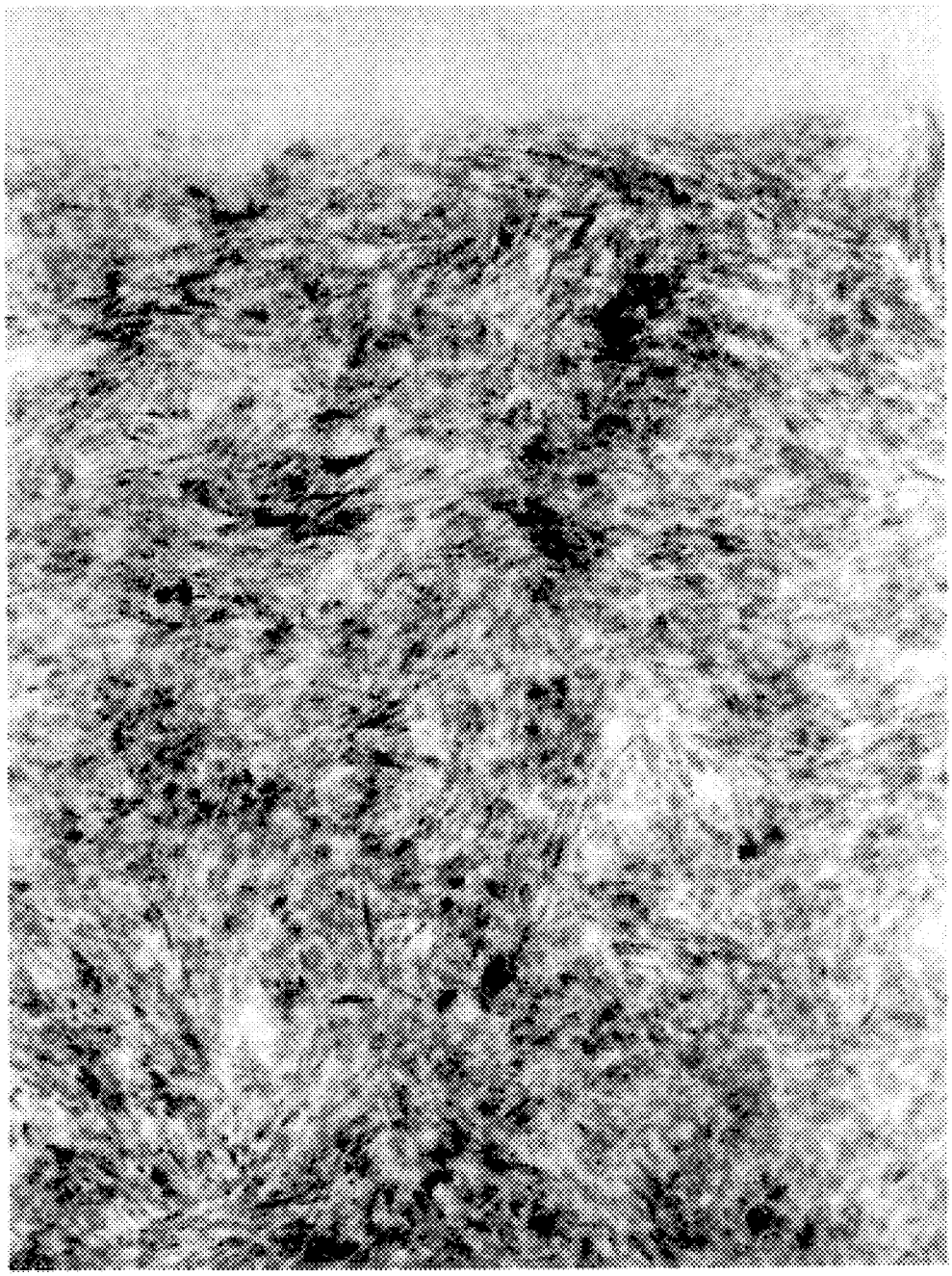
FIG. 3 is a photograph of the ink-receiving layer containing oriented alumina hydrate that was used in Comparative Example 1 and taken through a transmission electron microscope to show how oriented alumina hydrate appears in the ink-receiving layer.
Figure 4:
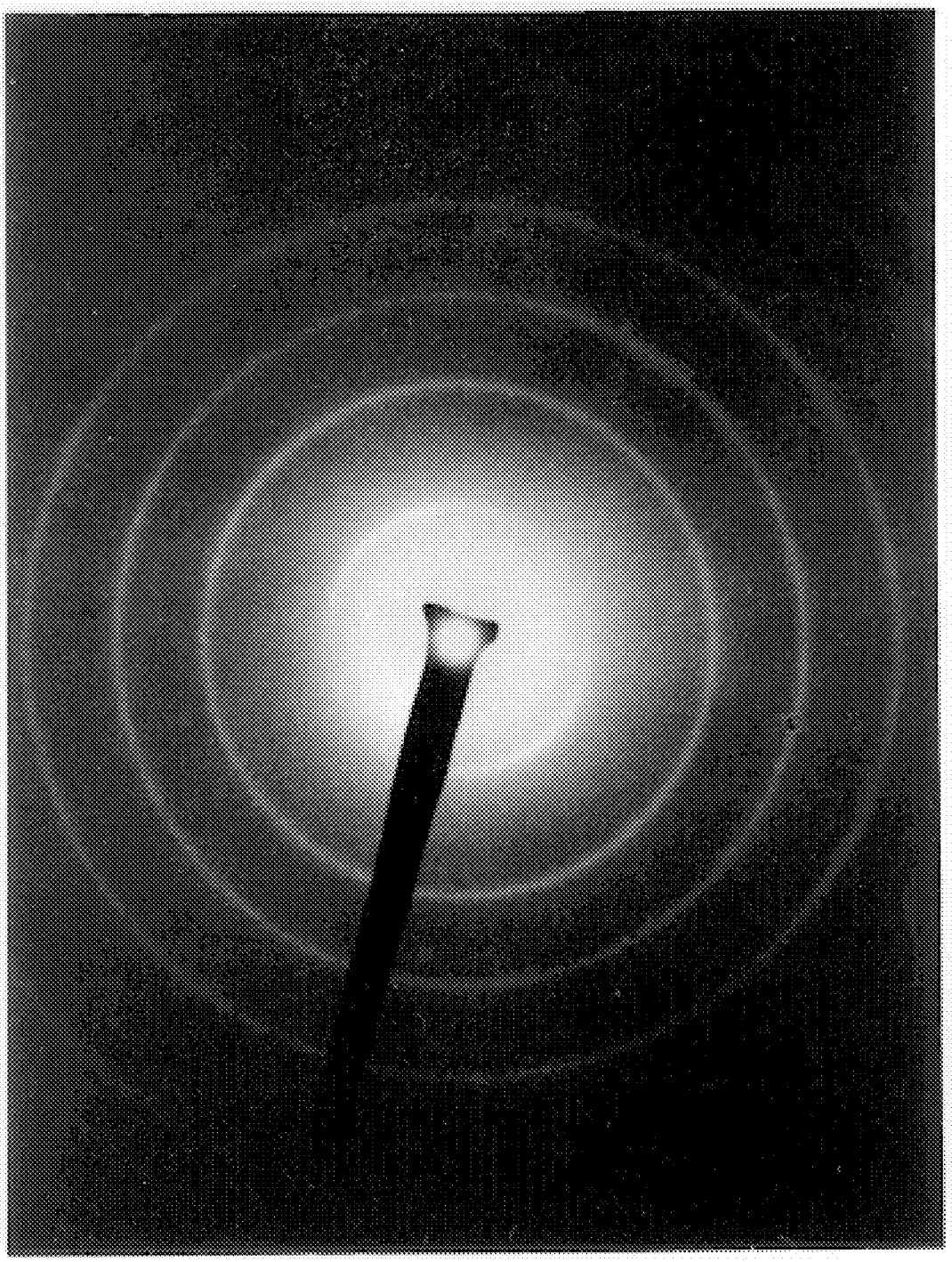
FIG. 4 is a photograph of an electron-diffraction pattern of a cross section of the ink-receiving layer containing oriented alumina hydrate that was used in Comparative Example 1.

A recording medium according to the present invention contains unoriented alumina hydrate as an essential ingredient. It comprises a substrate and an ink-receiving layer containing alumina hydrate formed on the substrate and a binding agent. The alumina hydrate is found unoriented in the ink-receiving layer. More specifically, as shown in the photograph of FIG. 1 (taken through a transmission electron microscope with a magnifying power of 200,000), particles of alumina hydrate contained in a recording medium according to the present invention are not oriented in any particular direction (unoriented) and the alumina hydrate does not have any oriented crystal plane so that electron beams are not diffracted strongly by any particular crystal planes. Thus, as shown in the electron-diffraction pattern of FIG. 2, all the diffraction rings show a substantially identical intensity distribution pattern for all the crystal planes. On the other hand, bundles of filaments of alumina hydrate (boehmite) oriented in a certain direction in the photograph of FIG. 3 (taken through a transmission electron microscope with a magnifying power of 200,000) shows a strong electron-diffraction that is produced by (020) plane and hence strong fluctuations in the diffraction rings of (020) plane as seen from the photograph of FIG. 4 (electron-diffraction pattern). For the purpose of the present invention, alumina hydrate meets the requirement defined by equation (1) below. That is to say, when the recording medium is cut from the surface of the medium to the bottom of the base and the exposed cross section of the ink-receiving layer is irradiated with electron beams, there is obtained a diffraction pattern of coaxially arranged rings. In this diffraction pattern, the diffraction intensity fluctuation δ represented by the equation (1) is not more than 5%:

$$\delta=[(\mathrm{Imax}-\mathrm{Imin})/(\mathrm{Imax}+\mathrm{Imin})]\times 100 \quad (1)$$

where Imax represents the largest diffraction intensity of a ring in the diffraction pattern and Imin represents the smallest diffraction intensity of a ring in the diffraction pattern.

The rate of ink absorption is particularly high to effectively prevent the occurrence of beading when the above requirement is met.

For the purpose of the present invention, alumina hydrate is expressed by the general formula $$Al_2O_{3-n}(OH)_{2n}.mH_2O \quad (2)$$

where n represents an integer of 0, 1, 2 or 3 and m represents a value between 0 and 10, preferably between 0 and 5, but both m and n should not be equal to 0 at the same time. In most cases, $mH_2O$ in the formula (2) above represents water molecules that have nothing to do with the formation of crystal lattice and hence can easily be released from the compound so that m may or may not be an integer. Additionally, m can become equal to 0 when such a material is calcined. Alumina hydrate can be prepared by appropriate known means such as hydrolysis of aluminum alkoxide or sodium aluminate. Rocek et al. report that the porous structure of alumina hydrate is influenced by the deposition temperature, the pH value of the solution, the maturing time, the surfactant involved and other factors (Collect. Czech. Chem. Commun., Vol. 56, 1253–1262, 1991). They also report that pseudo-boehmite may or may not take a cilia-like form in alumina hydrate (Rocek J. et al., Applied Catalysis, Vol. 74, 29–36, 1991). For the purpose of the present invention, alumina hydrate is spindle-shaped and shows an average aspect ratio between 1 and 4. The average aspect ratio can be determined by dividing the major axis of each particle by the minor axis. The profile of each particle is observed through a transmission electron microscope by following a procedure as will be described hereinafter.

A nitrogen adsorption/desorption technique can be used to simultaneously determine the BET specific surface area, the pore radius distribution and the pore volume of a given alumina hydrate and the pore radius distribution and the pore volume of the ink-receiving layer containing such alumina hydrate. For the purpose of the present invention, unoriented alumina hydrate preferably shows a BET specific surface area of 70 to 300 $m^2/g$. If the BET specific surface area falls below the above defined lower limit, the pore radius distribution can be lopsided in favor of the large side so that the dye contained in the ink cannot be satisfactorily adsorbed nor fixed. If, on the other hand, it exceeds the upper limit, the alumina hydrate may not be dispersed satisfactorily in the ink-receiving layer to make it difficult to accurately control the pore radius distribution.

For the purpose of the present invention, alumina hydrate is prepared through hydrolysis/deflocculation of aluminum alkoxide or of aluminum nitrate and sodium aluminate. As will be described hereinafter by referring to Examples, alumina hydrate in the form of spindle-shaped particles with an average aspect ratio between 1 and 4 can be obtained by means of a two-stage crystal growth process, although the present invention is not limited thereto by any means. Alternatively, for example, after forming alumina hydrogel slurry through hydrolysis of aluminum alkoxide or of aluminum nitrate and sodium aluminate, the obtained slurry may be spray-dried to produce powdery alumina hydrate, which is then dispersed into an acidic solution, to which sodium aluminate is added to prepare desired alumina hydrate through recrystallization and crystal growth. It should be noted that one tends to obtain unoriented and low anisotropic alumina hydrate particles, when raising the rate of crystal growth.

The recording medium according to the present invention is prepared by applying a solution that contains unoriented alumina hydrate as described above as pigment and a binding agent (dispersive solution of alumina hydrate) to a substrate to form an ink-receiving layer. The physical properties of the ink-receiving layer are determined as a function of not only the unoriented alumina hydrate used, but also various parameters including the type of the binding agent used, the concentration, the viscosity and the dispersiveness of the coating solution, the applicator including the head, the rate of application and the drying conditions. Therefore, the conditions for manufacturing an ink-receiving layer for the purpose of the present invention have to be carefully adjusted for optimization.

For the purpose of the present invention, the pores of the ink-receiving layer preferably show a maximum value found between 30 and 200 Å for the pore radius distribution. If the maximum pore radius exceeds the above defined upper limit, the image formed on the recording medium can bleed due to poor adsorption and fixation of the ink applied to it. If, on the other hand, the maximum pore radius falls below the lower limit, the ink applied to it will be poorly absorbed by the recording medium to give rise to beading.

Similarly, the pores of alumina hydrate in the ink-receiving layer preferably show a maximum value found between 30 and 200 Å for the pore radius distribution. It should be noted that the maximum pore radius of the ink-receiving layer is a function of that of the alumina hydrate contained in it.

The binding agent to be used with unoriented alumina hydrate in a recording medium according to the present invention can be selected from appropriate water soluble polymers including polyvinyl alcohol and modified products thereof, starch and modified products thereof, gelatin and modified products thereof, gum arabic, carboxymethyl cellulose, hydroxyethyl cellulose, hydroxypropylmethyl cellulose and other cellulose derivatives, SBR latex, NBR latex, latex of methylmethacrylate-butadiene copolymers and that of other conjugate diene copolymers, that of functional-group-modified polymers, latex of ethylene-vinyl acetate copolymers and that of other vinyl type copolymers, polyvinylpyrrolidone, maleic anhydride and its copolymers and acrylate copolymers. Any of these binding agents may be used solely or in combination. For the purpose of the present invention, the mixing ratio by weight of unoriented alumina hydrate to a binding agent is between 1:1 and 30:1, preferably between 5:1 and 25:1. If the binding agent falls below the above defined range, the obtained ink-receiving layer will have inadequate mechanical strength and eventually give rise to cracks and exfoliation. If, on the other hand, it exceeds the above range, the pore volume will be reduced and therefor the ink absorbency of the ink-receiving layer may be lowered.

For the purpose of the present invention, an alumina hydrate dispersant, a thickener, a pH modifier, a lubricant, a flowability modifier, a surfactant, a defoamer, a water-fastness imparting agent, a surface lubricant, a fluorescent brightening agent, a UV absorbing agent and/or an antioxidant may be added to the alumina hydrate and the binding agent, if necessary.

For the purpose of the present invention, the substrate of the ink-receiving layer of a recording medium according to the present invention may be made of appropriately sized paper, unsized paper, resin-coated paper typically using polyethylene or paper of some other type or a sheet of some other material such as thermoplastic film or cloth, although it is not subjected to any particular limitations.

To produce a recording medium that can compete with silver halide photography in terms of image quality, the substrate preferably has a basic weight of not less than 120 $g/m^2$, more preferably between 150 and 180 $g/m^2$ and is made of a fibrous material such as wood pulp.

For the purpose of the present invention, the ink-receiving layer may have a multilayer structure. For example, it may comprise a porous first ink-receiving layer containing barium sulfate and a second ink-receiving layer containing unoriented alumina hydrate laminated on a substrate in this order.

When barium sulfate is used, it should be purified as much as possible in order to improve the whiteness and the light fastness of the recording medium. The barium sulfate of the lower first layer preferably has an average particle diameter between 0.4 $\mu$m and 1.0 $\mu$m, more preferably between 0.4 $\mu$m and 0.8 $\mu$m to improve the surface smoothness of the lower layer. If the average particle diameter falls below 0.4 $\mu$m, the whiteness, the glossiness and the solvent absorbing ability of the recording medium will be degraded. If, on the other hand, the average particle diameter exceeds 1.0 $\mu$m, the whiteness and the glossiness of the recording medium will also be degraded.

Gelatin is preferably used as binder for binding barium sulfate in position because gelatin has a refractive index close to that of barium sulfate and, therefore, light will not significantly be reflected at any interface between them.

For the purpose of the present invention, gelatin may be treated with acid or alkali. Preferably, 6 to 12 parts by weight of gelatin is added to 100 parts by weight of barium sulfate when preparing a solution to be applied to the substrate for the purpose of the present invention. While chromium sulfate, chromium alum, formalin or triazine may typically be used for bridging gelatin, it is preferable to use chromium alum because it can be handled without difficulty. A bridging agent is added preferably at 0.2 to 4 parts by weight to 100 parts by weight of gelatin.

Barium sulfate is preferably applied to the substrate in a range of from 20 to 40 $g/m^2$ in terms of the solid content of the solution that contains barium sulfate in order to provide the recording medium with a sufficient ink-solvent absorbing ability and a required degree of smoothness. While the solution may be applied and dried with any method, it is preferable that a surface smoothing operation such as super calender is conducted as a finishing step, that the first ink-receiving layer has a whiteness of not less than 87% and that the Bekk smoothness of the surface is not less than 400 seconds.

On the other hand, the Bekk smoothness of the surface is preferably not greater than 600 seconds, more preferably not greater than 500 seconds, because too smooth a surface absorbs ink poorly.

Figure 5:
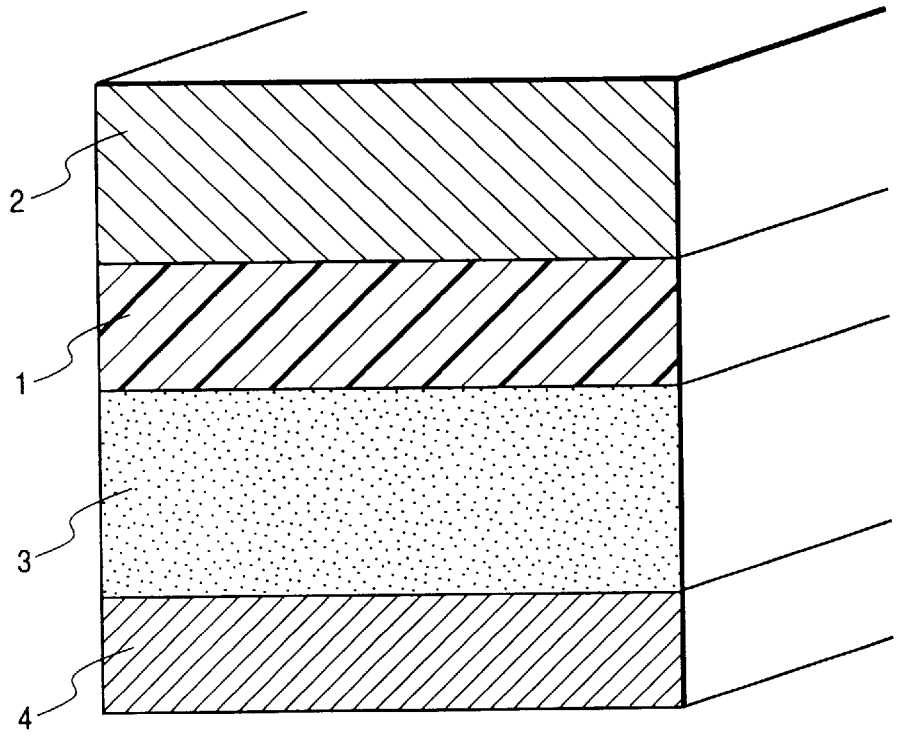
FIG. 5 is a schematic illustration of a recording medium according to the present invention provided with a release liner on the rear side of the substrate.

As shown in FIG. 5, the substrate 1 of a recording medium according to the present invention may be provided with a release liner 4 on the rear side (the side opposite to the one carrying the ink-receiving layer 2) through a layer of an adhesive agent such as a pressure-sensitive adhesive agent layer 3 interposed therebetween in order to make the recording medium adherent. With this arrangement, the recording medium may be made to stick to an appropriate surface by peeling off the release liner 4.

Further, in the present invention there may be provided a porous layer comprising thermoplastic resin particles as a surface layer on the ink-receiving layer, whereby an ink applied reaches an underlaying layer of the ink-receiving layer through the porous layer to form an image thereon, and then, when the porous surface layer is made nonporous, a print having a high optical density and excellent weather fastness can be obtained.

The thermoplastic resin particles used in the present invention are preferably particles formed of a latex.

For the purpose of the present invention, an ink-receiving layer may be formed on a substrate by applying a solution containing unoriented and dispersed alumina hydrate onto the surface of the substrate by means of an applicator and drying the applied solution. A blade coater, an air knife coater, a roll coater, a curtain coater, a bar coater, a gravure coater or a sprayer may be used as the applicator for the purpose of the present invention. The dispersive solution of unoriented alumina hydrate is applied to the surface of the substrate at a rate preferably between 0.5 and 60 $g/m^2$, more preferably between 5 and 45 $g/m^2$, as dried coating. If necessary, the surface of the formed ink-receiving layer may be smoothed by means of a calender machine.

An ink-jet recording method according to the present invention uses a recording medium as described above. Ink droplets are ejected onto a recording medium to produce and record images and/or characters on the medium. While either a bubble-jet system or a piezoelectric system may be used with an ink-jet recording method according to the present invention, a bubble-jet system may be preferable because it is more adapted to printing fine characters at high speed. Preferably, a water-based ink is used and may be colored by either a dye or a pigment.

In the case that the recording medium of the present invention has a surface layer, the surface layer is made nonporous (transparent) by subjecting it to a heat treatment, after images are formed by applying an ink. When the porous layer is subjected to such a treatment, an image formed on the recording medium is improved in weather fastness such as water fastness and light fastness, and good gloss can be imparted to the image.

Now, the present invention will be described in greater detail by way of examples, which do not limit the present invention by any means. The physical properties of the specimens were observed by the following methods.

(1) BET Specific Surface Area, Pore Radius Distribution, and Pore Volume

The specimens were heated and deaerated satisfactorily before being observed by means of a nitrogen adsorption/desorption method (using Omnisorp 360, trade name; available from COULTER Co.).

(2) Observation of Alumina Hydrate (Aspect Ratio, and Particle Profile)

The specimens were prepared either directly from powdery alumina hydrate or by dispersing it in deionized water to a concentration between 1 and 2% and then dipping out of the solution by means of a collodion-coated copper mesh to remove excess water. To observe the ink-receiving layer, the specimens were prepared by cutting each recording medium into very thin sections of 500 to 4,000 Å by means of a microtome. The prepared specimens were then observed through a transmission electron microscope (H-800, trade name; available from Hitachi Co.). The average aspect ratio was determined by dividing the major axis of each particle by the minor axis.

(3) Selected-Area Electron Diffraction Pattern and Measurement of the Diffraction Intensity Fluctuation The specimens were prepared by cutting each recording medium comprising a substrate and an ink-receiving layer into very thin sections of 700±100 Å by means of a microtome. An area selected for diffraction was defined by 2,000 Åϕ and the values obtained at 10 different cross sections were averaged. The electron diffraction of each cross section of the ink-receiving layer was observed by means of an electron diffractometer (H-800, trade name; available from Hitachi Co.) and the diffraction intensity of the diffraction pattern was transferred onto an imaging plate (available from Fuji Photo Film Co.) to observe the intensity distribution of the diffraction pattern for each lattice plane. The diffraction intensity fluctuation was determined by means of equation (1) above.

(4) Printing Characteristics

Ink-jet printing was conducted on the specimens using a color ink-jet printer with Y (yellow), M (magenta), C (cyan) and Bk (black) ink-jet heads, each having 128 nozzles arranged at a rate of 16 nozzles per mm, and inks having the compositions listed below. Then, they were observed for ink absorption, image density, bleeding and beading.

<1> Ink Absorption

The specimens were solid printed for both mono-color printing and multi-color printing with inks having the compositions listed below and each of the specimens was tested for surface ink absorption by touching the printed areas of the recording medium with a finger tip. The amount of ink per unit area at mono-color printing was defined to be 100%. A multi-color printing that did not smear the finger tip with ink when the amount of ink per unit area was 300% was ranked as "A", and a multi-color printing that smeared the finger tip with ink when the amount of ink per unit area was 300% but did not when the amount of ink per unit area was 200% was ranked as "B".

<2> Optical Density

The solid prints obtained by using each Y, M, C and Bk inks with Ink Composition 1 below were observed for optical density by means of Macbeth Reflection Densitometer RD-918.

<3> Bleeding and Beading

The specimens were solid printed for both mono-color printing and multi-color printing with inks having Ink Composition 1 below and each of the specimens was observed for surface bleeding. As for beading, the specimens were solid printed for both mono-color printing and multi-color printing with two types of inks having the compositions listed below and each of the specimens was visually observed for beading. The amount of ink per unit area printed with a mono-color ink was defined to be 100%. A multi-color printing that did not show any bleeding and beading when the amount of ink per unit area was 300% was ranked as "A", and a multi-color printing that showed bleeding and/or beading when the amount of ink per unit area was 300% but did not when the amount of ink per unit area was 200% was ranked as "B".

The following compositions are expressed in terms of weight.

| | |
|---|---|
| (Ink Composition 1) | |
| Dye (Y, M, C or Bk as shown below) | 5 parts |
| Ethylene glycol | 10 parts |
| Polyethylene glycol | 10 parts |
| Water | 75 parts |
| (Ink Composition 2) | |
| Dye (Y, M, C or Bk as shown below) | 5 parts |
| Ethylene glycol | 15 parts |
| Polyethylene glycol | 10 parts |
| Water | 70 parts |

(Dye)
Y: C. I. Direct Yellow 86
M: C. I. Acid Red 35
C: C. I. Direct Blue 199
Bk: C. I. Hood Black 2

EXAMPLES 1 to 3

Aluminum octaoxide was synthetically prepared and hydrolyzed to produce an alumina slurry by a method described in U.S. Pat. No. 4,242,271 or U.S. Pat. No. 4,202,870. Water was added to the alumina slurry up to a solid content of alumina hydrate of 5%. Thereafter, the slurry was heated at 80° C. for 10 hours for a maturing reaction and the obtained colloidal sol was sprayed and dried to produce alumina hydrate. The obtained alumina hydrate was then mixed with and dispersed into deionized water, whose pH value was adjusted to 5 with nitric acid. Then, the mixture was heated to 95° C. and sodium aluminate was added thereto until the pH rose to 10. Specimens were prepared for Examples 1 to 3 by maturing the mixture for 5 hours (Example 1), 10 hours (Example 2) and 15 hours (Example 3), respectively. The colloidal sols were desalted and then deflocculated by adding acetic acid. When the alumina hydrate products obtained by drying the colloidal sols were observed by X-ray diffractometry, they were found to be pseudo-boehmite. When observed through a transmission electron microscope, all the alumina hydrate products were found in the form of spindle-shaped particles. The physical properties of the alumina hydrate products obtained by the above described measurements are listed in Table 1.

Figure 2:
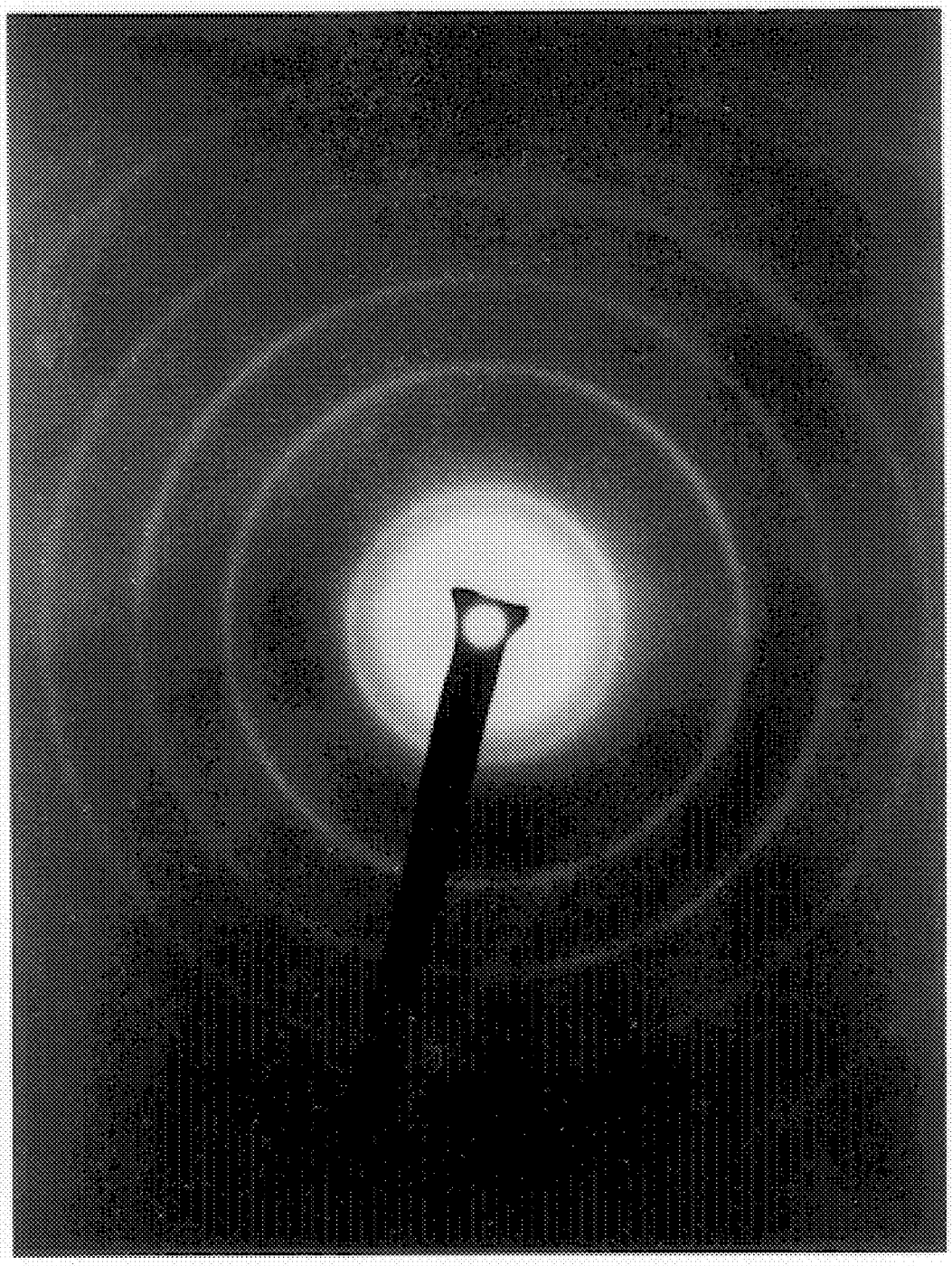
FIG. 2 is an electron-diffraction pattern of a cross section of the ink-receiving layer containing unoriented alumina hydrate of a recording medium according to the present invention obtained by diffractometry.

Polyvinyl alcohol PVA117 (trade name; available from Kuraray Co.) was dissolved into deionized water to produce a 10% by weight solution. Each colloidal sol of the three alumina hydrate products was condensed to produce a 15% by weight solution. Then, the colloidal sol of alumina hydrate and the polyvinyl alcohol solution were mixed with each other such that the solid alumina hydrate and the solid polyvinyl alcohol showed a ratio by weight of 10:1 and the mixture was agitated to produce a dispersive solution. Subsequently, the dispersive solution was applied to a 100 μm thick PET film (Lumirror, trade name; available from Toray Co.) by means of a die coater and dried to produce an ink-receiving layer. FIG. 1 is a photograph showing a cross section of the ink-receiving layer (taken through a transmission electron microscope with a magnifying power of 200,000). It will be seen that alumina hydrate is in the form of unoriented spindle-shaped particles. The cross section was then subjected to electron diffractometry to further look into it. FIG. 2 shows a photograph taken by electron diffractometry. Table 2 summarily shows the physical properties of the ink-receiving layer obtained by the above described methods.

EXAMPLE 4

A colloidal sol of alumina hydrate was synthetically prepared through hydrolysis of an aqueous solution of aluminum nitrate and that of sodium aluminate. The concentration and the amount of each of the materials was adjusted so as to be 5% of the concentration of solid alumina hydrate and the pH 9 of the product after adding sodium aluminate, respectively. Thereafter, the product was heated at 90° C. for 10 hours for maturing. The obtained colloidal sol was desalted and then spray-dried to produce alumina hydrate. The obtained alumina hydrate was then mixed with and dispersed into deionized water, whose pH value was adjusted to 5 by means of nitric acid. Then, the mixture was heated to 95° C. and sodium aluminate was added thereto to adjust the pH to 10. Colloidal sol was prepared by maturing the mixture for 15 hours. The obtained colloidal sol was desalted and then deflocculated by adding acetic acid. When the alumina hydrate product obtained by drying the colloidal sol was observed by X-ray diffractometry, it was found to be pseudo-boehmite. When observed through a transmission electron microscope, all the alumina hydrate products were found in the form of spindle-shaped particles. The physical properties of the alumina hydrate product obtained by the above described measurements are also listed in Table 1. An ink-receiving ,layer was formed, and its electron diffraction and physical properties were measured as in Examples 1 to 3. Table 2 summarily shows the obtained result.

EXAMPLE 5

A colloidal sol of alumina hydrate was synthetically prepared through hydrolysis of an aqueous solution of aluminum nitrate and that of sodium aluminate as in Example 4. Firstly, an aqueous solution of sodium aluminate was added to an aqueous solution of aluminum nitrate so as to be pH 5 to deposit crystals of alumina hydrate and then the mixture was left at 30° C. for 2 hours while stirring the mixture constantly. Thereafter, sodium aluminate was added again to adjust the pH to 9 and the mixture was matured at 90° C. for 10 hours. The concentration of solid alumina hydrate was so adjusted as to become equal to 5% after the synthesis.

The obtained colloidal sol was then processed as in Example 4 to produce alumina hydrate. The physical properties of the alumina hydrate product were measured as in Example 1 and also listed in Table 1. A recording medium of the present invention was prepared and an electron diffractometry and physical properties of an ink-receiving layer were observed as in Example 1. Table 2 summarily shows the obtained result.

EXAMPLE 6

Alumina hydrate was prepared as in Example 5 except that the mixture was left for 4 hours after the deposition of crystals of alumina hydrate at pH 5.

The physical properties of the alumina hydrate product were measured as in Example 1 and also listed in Table 1. An ink-receiving layer was formed and observed by electron diffractometry and its physical properties were analyzed as in Example 1. Table 2 summarily shows the obtained result.

EXAMPLE 7

An ink-receiving layer was prepared as in Example 1 except that the substrate was replaced by a 75 μm thick PET film and the dried ink-receiving layer had a thickness of about 30 μm.

A pressure-sensitive adhesive agent prepared for sticky labels by using acrylate type copolymer as a base polymer was applied to the release liner to a thickness of about 50 μm by means of a blade coater. The release liner was then applied to the rear side of the PET film of the prepared recording medium to produce a recording sheet. The obtained recording medium could be made to stick to any appropriate surface by peeling off the release liner.

COMPARATIVE EXAMPLE 1

Figure 6:
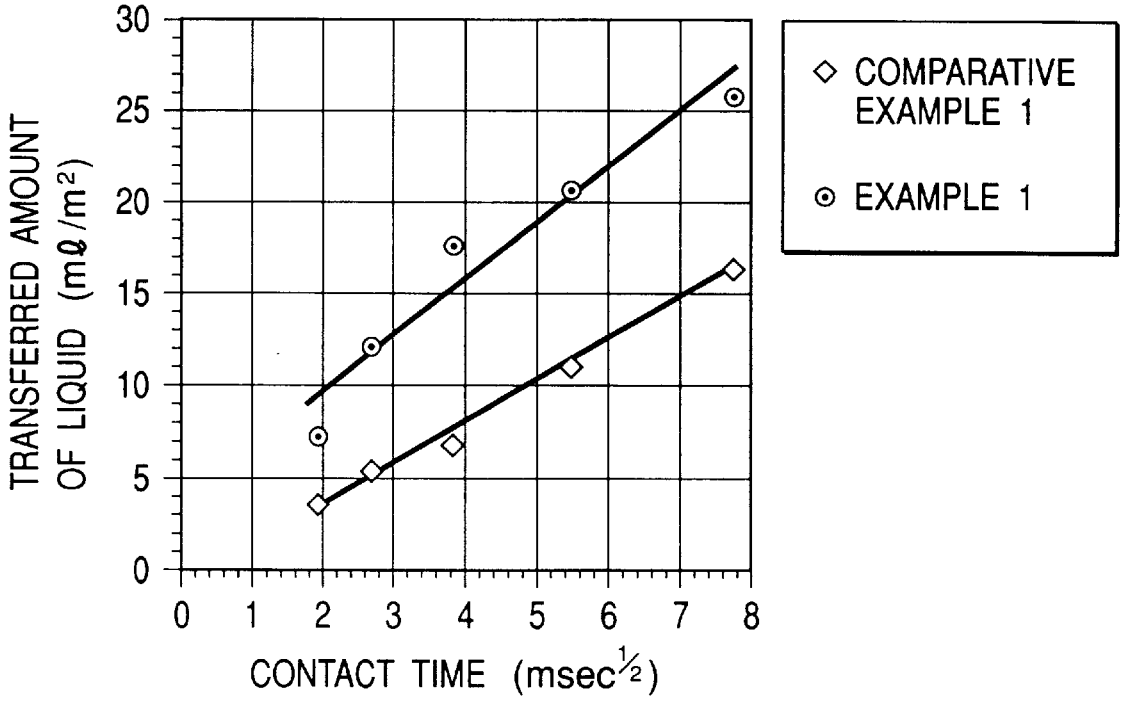
FIG. 6 is a graph showing the results of a measurement conducted on the recording medium of Example 1 and that of Comparative Example 1 by means of a Bristow tester.

Alumina hydrate (sol) was synthetically prepared in the form of bundles of filaments (cilia-like form) through hydrolysis/deflocculation of aluminum isopropoxide. Then, an ink-receiving layer was prepared therefrom and a recording medium was produced by using the ink-receiving layer as in Example 1. A cross section of the ink-receiving layer was observed through a transmission electron microscope and also by electron diffractometry and the physical properties of the ink-receiving layer were measured. The obtained physical properties of the alumina hydrate and those of the ink-receiving layer are summarily shown in Tables 1 and 2. FIG. 6 shows the result of a measurement using a Bristow tester available from Toyo-Seiki Manufacturing and conducted on the specimens of the recording media of Example 1 and Comparative Example 1 for ink absorption. FIG. 6 shows a relationship between a contact time ($msec^{1/2}$) and a transferred amount of liquid ($ml/m^2$). As seen from FIG. 6, ink is absorbed much quicker by a recording medium comprising an ink-receiving layer of unoriented alumina hydrate than by a recording medium comprising an ink-receiving layer of oriented alumina hydrate.

TABLE 1

| Physical property/Sample | Ex. 1 | Ex. 2 | Ex. 3 | Ex. 4 | Ex. 5 | Ex. 6 | Comp. Ex. 1 |
|---|---|---|---|---|---|---|---|
| Average aspect ratio | 3 | 3 | 2 | 3 | 3 | 4 | 10 |
| Max. pore radius | 50 | 85 | 125 | 90 | 89 | 92 | 84 |
| BET specific surface area ($m^2/g$) | 231 | 158 | 75 | 150 | 153 | 156 | 187 |
| Pore volume (cc/g) | 0.65 | 0.78 | 0.84 | 0.81 | 0.79 | 0.80 | 0.83 |

TABLE 2

| Physical property/Sample | Ex. 1 | Ex. 2 | Ex. 3 | Ex. 4 | Ex. 5 | Ex. 6 | Comp. Ex. 1 |
|---|---|---|---|---|---|---|---|
| Max. pore radius (Å) | 45 | 85 | 120 | 82 | 85 | 88 | 75 |
| Pore volume (cc/g) | 0.62 | 0.75 | 0.80 | 0.77 | 0.79 | 0.81 | 0.80 |
| Printing characteristics | | | | | | | |
| Absorption | A | A | A | A | A | A | B |
| Image density | | | | | | | |
| Y | 1.70 | 1.68 | 1.63 | 1.70 | 1.67 | 1.68 | 1.61 |
| M | 1.59 | 1.63 | 1.58 | 1.65 | 1.60 | 1.62 | 1.60 |
| C | 1.72 | 1.70 | 1.71 | 1.72 | 1.72 | 1.70 | 1.65 |
| Bk | 1.76 | 1.74 | 1.72 | 1.75 | 1.73 | 1.72 | 1.68 |
| Bleeding and beading | A | A | A | A | A | A | B |
| Ink Comp. 1 | A | A | A | A | A | A | B |
| Ink Comp. 2 | A | A | A | A | A | A | B |
| Fluctuation in diffraction (%) intensity | 0.6 | 0.8 | 1.2 | 0.9 | 3.4 | 5.0 | 23 |

EXAMPLE 8

A solution to be applied was prepared by mixing 100 parts by weight of barium sulfate with an average particle diameter of 0.6 $\mu$m produced by causing sodium sulfate to react with barium chloride, 10 parts by weight of gelatin, 3 parts by weight of polyethylene glycol and 0.4 part by weight of chromium alum. The solution was applied to a base paper to be coated with a basis weight of 150 $g/m^2$, a Stockigt sizing degree of 200 seconds and a Bekk smoothness of 340 seconds to a dried thickness of 20 $\mu$m by means of a die coater and then the paper was processed by a super calender to produce a recording medium with a surface smoothness of 400 seconds.

Aluminum octaoxide was synthetically prepared and hydrolyzed to produce an alumina slurry by a method described in U.S. Pat. No. 4,242,271 or U.S. Pat. No. 4,202,870. Water was added to the alumina slurry up to a solid concentration of alumina of 5%. Thereafter, the slurry was heated at 80° C. for 10 hours for a maturing reaction and the obtained colloidal sol was spray-dried to produce alumina hydrate. The obtained alumina hydrate was then mixed with and dispersed into deionized water, whose pH value was adjusted to 5 with nitric acid. Then, the mixture was heated to 95° C. and sodium aluminate was added thereto until the pH rose to 10. The colloidal sols were desalted and then deflocculated by adding acetic acid. When the alumina hydrate products obtained by drying the colloidal sols were observed by X-ray diffractometry, they were found to be pseudo-boehmite. When observed through a transmission electron microscope, all the alumina hydrate products were found in the form of spindle-shaped particles.

The solution was then applied to the above recording medium by means of a bar coater until the basis weight got to 20 $g/m^2$ after the application and then dried at 100° C. for 10 minutes in an oven. Thereafter, the alumina hydrate was baked at 150° C. for 2 minutes to produce porous alumina hydrate for a recording medium according to the present invention.

The finished recording medium was then used for printing and the printed image was tested for various physical properties. Table 3 summarily shows the obtained result.

In Table 3, the smoothness was measured as follows. By means of a Bekk smoothness meter (available from Yoshimitsu-Seiki Co.) under the conditions of the range "1 cc" which is for high smoothness specimen, the readings multiplied by 10 were smoothness. The whiteness was measured by means of a Hunter Reflectometer (available from Toyo-Seiki Manufacturing Co.) to which a blue filter was attached. As for glossiness, the 75° glossiness was measured by means of a digital variable glossimeter (available from Suga Shikenki Co.) in accordance with JIS P 8142.

EXAMPLE 9

Base paper and a barium sulfate solution the same as those of Example 8 were used to form an ink-receiving layer to a dry thickness of 13 $\mu$m and a recording medium with a surface smoothness of 320 seconds was prepared by means of a super calender.

A coating solution containing pseudo-boehmite as used in Example 8 was applied onto the medium by means of a bar coater until the basis weight got to 20 $g/m^2$ after the application and then dried at 100° C. for 10 minutes in an oven. Thereafter, the alumina hydrate was baked at 150° C. for 2 minutes to produce a finished recording medium.

The finished recording medium was then used for printing and the printed image was tested for various physical properties as in Example 8. Table 3 summarily shows the obtained result.

EXAMPLE 10

A latex (an average particle size of 0.2 $\mu$m) was applied to the ink receiving layer of the recording medium prepared as in Example 1 by a bar coater so as to have a dry thickness of about 5 $\mu$m, and then dried in an oven at 60° C. for 10 minutes. When printed on the thus obtained recording medium by means of an ink-jet printer, the ink passed through the resin layer formed of the latex, and thereby made images on the ink-receiving layer. Images veiled with a white resin layer formed of a latex were observed. When heated in an oven at 130° C. for 10 minutes, the resin layer formed of the latex as the surface layer was molten to form a transparent film, so that a high glossy image free from ozone fading (ozone resistant image) can be obtained.

As described above, a recording medium according to the present invention contains alumina hydrate that is unoriented and shows a diffraction intensity fluctuation not exceeding 5% in the ink-receiving layer. Thus, ink is absorbed much quicker by a recording medium according to the present invention than by a recording medium comprising an ink-receiving layer of oriented alumina hydrate in the form of bundles of filaments (cilia-like form).

TABLE 3

| | Example 8 | Example 9 |
|---|---|---|
| Bekk smoothness (second) | 400 | 320 |
| Whiteness (%) | 87.5 | 87.6 |
| 75° glossiness (%) | 61.0 | 51.6 |
| Ink absorption | A | A |
| Image density Y | 1.65 | 1.63 |
| Image density M | 1.66 | 1.60 |
| Image density C | 1.69 | 1.66 |
| Image density Bk | 1.72 | 1.66 |
| Bleeding and beading for Composition 1 | A | A |
| Bleeding and beading for Composition 2 | A | A |

TABLE 3-continued

| | Example 8 | Example 9 |
|---|---|---|
| Fluctuation in diffraction intensity (%) | 0.8 | 0.8 |

What is claimed is:

1. A recording medium comprising a substrate, a first ink-receiving layer that is porous and contains barium sulfate, and a second ink-receiving layer containing alumina hydrate formed thereon, wherein the alumina hydrate is present unoriented in the ink-receiving layer and a diffraction intensity fluctuation δ in a diffraction pattern is not more than 5%, when irradiating an electron beam to a cross section of the ink-receiving layer.

2. The recording medium according to claim 1, wherein said first ink-receiving layer has a whiteness equal to 87% or more and a Bekk smoothness equal to 400 seconds or more.

3. The recording medium according to claim 2, wherein said Bekk smoothness is equal to 600 seconds or less.

4. The recording medium according to claim 1, wherein said substrate is provided on the rear side thereof with a release liner with an adhesive agent disposed between said substrate and said release liner.

5. An ink-jet recording method, comprising ejecting ink droplets onto a recording medium according to either one of claims 1 and 4.

* * * * *

UNITED STATES PATENT AND TRADEMARK OFFICE

CERTIFICATE OF CORRECTION

PATENT NO. : 6,200,670 B1 
DATED : March 13, 2001
INVENTOR(S) : Nobuyuki Hosoi et al.

It is certified that error appears in the above-identified patent and that said Letters Patent is hereby corrected as shown below:

Title page,
Item [56], References Cited, FOREIGN PATENT DOCUMENTS,
"55-49113" should read -- 53-49113 --; and
"53-51583" should read -- 55-51583 --.

Column 2,
Line 20, "aggrgation" should read -- aggregation --.
Line 34, "above identified" should read -- above-identified --.

Column 4,
Line 24, "above defined" should read -- above-defined --.
Line 66, "above defined" should read -- above-defined --.

Column 5,
Line 29, "above defined" should read -- above-defined --.

Column 9,
Line 8, "above described" should read -- above-described --.
Line 29, "above described" should read -- above-described --.
Line 55, "above described" should read -- above-described --.
Line 56, ", layer" should read -- layer --.

Signed and Sealed this

Seventeenth Day of December, 2002

JAMES E. ROGAN
*Director of the United States Patent and Trademark Office*